US009551963B2

(12) United States Patent
Tada et al.

(10) Patent No.: US 9,551,963 B2
(45) Date of Patent: Jan. 24, 2017

(54) FIXING DEVICE HAVING A HEATER AND REFLECTOR ARRANGEMENT AND IMAGE FORMING APPARATUS HAVING SAME

(71) Applicants: Takeshi Tada, Kanagawa (JP); Ippei Fujimoto, Kanagawa (JP); Takakuni Minewaki, Kanagawa (JP); Susumu Matsusaka, Kanagawa (JP); Fumihito Masubuchi, Kanagawa (JP)

(72) Inventors: Takeshi Tada, Kanagawa (JP); Ippei Fujimoto, Kanagawa (JP); Takakuni Minewaki, Kanagawa (JP); Susumu Matsusaka, Kanagawa (JP); Fumihito Masubuchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/723,529

(22) Filed: May 28, 2015

(65) Prior Publication Data

US 2015/0355587 A1 Dec. 10, 2015

(30) Foreign Application Priority Data

Jun. 9, 2014 (JP) ..... 2014-118627

(51) Int. Cl.
*G03G 15/20* (2006.01)

(52) U.S. Cl.
CPC ..... *G03G 15/2064* (2013.01); *G03G 15/2053* (2013.01); *G03G 2215/2035* (2013.01)

(58) Field of Classification Search
CPC ..... G03G 15/20–15/2096
See application file for complete search history.

(56) References Cited

U.S. PATENT DOCUMENTS

| | | | | |
|---|---|---|---|---|
| 3,452,181 | A * | 6/1969 | Stryjewski | G03G 15/2007 219/216 |
| 5,528,351 | A * | 6/1996 | Tsuji | G03G 15/2064 219/216 |
| 8,953,994 | B2 * | 2/2015 | Iwaya | G03G 15/2053 399/328 |
| 2006/0177251 | A1 * | 8/2006 | Uehara | G03G 15/2064 399/329 |
| 2007/0292175 | A1 | 12/2007 | Shinshi | |
| 2009/0092423 | A1 * | 4/2009 | Shin | G03G 15/2064 399/329 |

(Continued)

FOREIGN PATENT DOCUMENTS

| | | |
|---|---|---|
| JP | 4-044083 | 2/1992 |
| JP | 2004-286922 | 10/2004 |

(Continued)

*Primary Examiner* — Clayton E Laballe
*Assistant Examiner* — Ruifeng Pu
(74) *Attorney, Agent, or Firm* — Harness, Dickey & Pierce, P.L.C.

(57) ABSTRACT

A fixing device includes a fixing rotator rotatable in a given direction of rotation and a pressure rotator pressed against the fixing rotator to form a fixing nip therebetween, through which a recording medium is conveyed. A first heater is disposed opposite the fixing rotator with a first interval therebetween to heat the fixing rotator. A reflector reflects light emitted by the first heater to the fixing rotator. The reflector is disposed opposite the first heater with a second interval therebetween that is greater than the first interval.

39 Claims, 8 Drawing Sheets

(56) References Cited

U.S. PATENT DOCUMENTS

| | | | | |
|---|---|---|---|---|
| 2010/0158587 | A1* | 6/2010 | Shin | G03G 15/2039 399/329 |
| 2011/0116848 | A1* | 5/2011 | Yamaguchi | G03G 15/2064 399/329 |
| 2012/0008971 | A1* | 1/2012 | Lee | G03G 15/2064 399/69 |
| 2013/0195525 | A1 | 8/2013 | Yoshinaga et al. | |
| 2013/0209123 | A1* | 8/2013 | Waida | G03G 15/205 399/68 |
| 2013/0209127 | A1* | 8/2013 | Fujimoto | G03G 15/2046 399/69 |
| 2013/0209147 | A1* | 8/2013 | Ogawa | G03G 15/2028 399/329 |
| 2013/0209148 | A1* | 8/2013 | Suto | G03G 15/2053 399/333 |
| 2013/0308990 | A1* | 11/2013 | Samei | G03G 15/2053 399/329 |
| 2014/0072355 | A1 | 3/2014 | Tamaki et al. | |
| 2014/0286684 | A1 | 9/2014 | Takagi et al. | |
| 2014/0341625 | A1* | 11/2014 | Imada | G03G 15/2017 399/329 |
| 2014/0341626 | A1 | 11/2014 | Mimbu et al. | |
| 2014/0341627 | A1 | 11/2014 | Yoshikawa et al. | |
| 2014/0356036 | A1* | 12/2014 | Shimokawa | G03G 15/2053 399/329 |
| 2014/0356037 | A1* | 12/2014 | Shimokawa | G03G 15/2053 399/329 |
| 2015/0125193 | A1* | 5/2015 | Ishii | G03G 15/2085 399/329 |

FOREIGN PATENT DOCUMENTS

| | | |
|---|---|---|
| JP | 2005-165098 | 6/2005 |
| JP | 2007-334205 | 12/2007 |
| JP | 2010-032625 | 2/2010 |
| JP | 2013-178461 | 9/2013 |
| JP | 2014-059382 | 4/2014 |
| JP | 2014-164223 | 9/2014 |
| JP | 2014-174440 | 9/2014 |
| JP | 2014-182174 | 9/2014 |
| JP | 2014-186211 | 10/2014 |

* cited by examiner

FIXING DEVICE HAVING A HEATER AND REFLECTOR ARRANGEMENT AND IMAGE FORMING APPARATUS HAVING SAME

CROSS-REFERENCE TO RELATED APPLICATION

This patent application is based on and claims priority pursuant to 35 U.S.C. §119 to Japanese Patent Application No. 2014-118627, filed on Jun. 9, 2014, in the Japanese Patent Office, the entire disclosure of which is hereby incorporated by reference herein.

BACKGROUND

Technical Field

Example embodiments generally relate to a fixing device and an image forming apparatus, and more particularly, to a fixing device for fixing a toner image on a recording medium and an image forming apparatus incorporating the fixing device.

Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which the recording medium bearing the toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

At least one embodiment provides a novel fixing device that includes a fixing rotator rotatable in a given direction of rotation and a pressure rotator pressed against the fixing rotator to form a fixing nip therebetween, through which a recording medium is conveyed. A first heater is disposed opposite the fixing rotator with a first interval therebetween to heat the fixing rotator. A reflector reflects light emitted by the first heater to the fixing rotator. The reflector is disposed opposite the first heater with a second interval therebetween that is greater than the first interval.

At least one embodiment provides a novel image forming apparatus that includes an image bearer to bear a toner image and a fixing device, disposed downstream from the image bearer in a recording medium conveyance direction, to fix the toner image transferred from the image bearer onto a recording medium thereon. The fixing device includes a fixing rotator rotatable in a given direction of rotation and a pressure rotator pressed against the fixing rotator to form a fixing nip therebetween, through which a recording medium is conveyed. A first heater is disposed opposite the fixing rotator with a first interval therebetween to heat the fixing rotator. A reflector reflects light emitted by the first heater to the fixing rotator. The reflector is disposed opposite the first heater with a second interval therebetween that is greater than the first interval.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
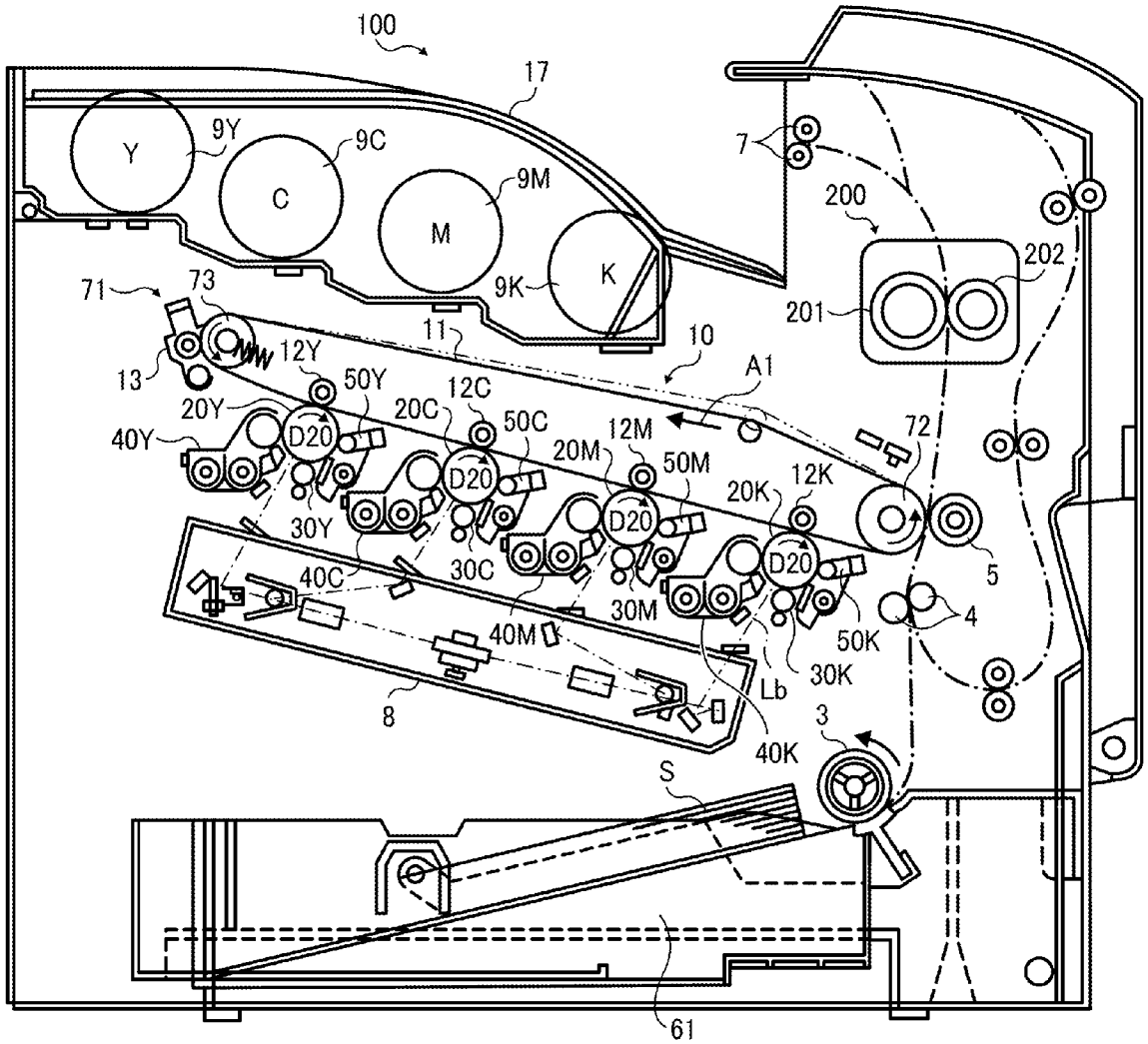
FIG. 1 is a schematic vertical sectional view of an image forming apparatus according to an example embodiment of the present disclosure.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors used herein are interpreted accordingly.

Although the terms first, second, and the like may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present disclosure.

The terminology used herein is for the purpose of describing particular embodiments only and is not intended to be limiting of the present disclosure. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 100 according to an example embodiment is explained.

FIG. 1 is a schematic vertical sectional view of the image forming apparatus 100. The image forming apparatus 100 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 100 is a color printer that forms color and monochrome toner images on recording media by electrophotography. Alternatively, the image forming apparatus 100 may be a monochrome printer that forms monochrome toner images.

With reference to FIG. 1, a description is provided of a construction of the image forming apparatus 100.

The image forming apparatus 100 is a color printer employing a tandem system in which a plurality of image forming devices for forming toner images in a plurality of colors, respectively, is aligned in a stretch direction of a transfer belt.

The image forming apparatus 100 employs a tandem structure in which four photoconductive drums 20Y, 20C, 20M, and 20K serving as image bearers that bear yellow, cyan, magenta, and black toner images in separation colors, respectively, are aligned.

The yellow, cyan, magenta, and black toner images formed on the photoconductive drums 20Y, 20C, 20M, and 20K, respectively, are primarily transferred successively onto an endless transfer belt 11 serving as an intermediate transferor disposed opposite the photoconductive drums 20Y, 20C, 20M, and 20K as the transfer belt 11 rotates in a rotation direction A1 such that the yellow, cyan, magenta, and black toner images are superimposed on a same position on the transfer belt 11 in a primary transfer process. Thereafter, the yellow, cyan, magenta, and black toner images superimposed on the transfer belt 11 are secondarily transferred onto a recording medium S (e.g., a recording sheet and a transfer sheet) collectively in a secondary transfer process.

Each of the photoconductive drums 20Y, 20C, 20M, and 20K is surrounded by image forming components that form the yellow, cyan, magenta, and black toner images on the photoconductive drums 20Y, 20C, 20M, and 20K as they rotate clockwise in FIG. 1 in a rotation direction D20. Taking the photoconductive drum 20K that forms the black toner image, the following describes an image forming operation to form the black toner image. The photoconductive drum 20K is surrounded by a charger 30K, a developing device 40K, a primary transfer roller 12K, and a cleaner 50K in this order in the rotation direction D20 of the photoconductive drum 20K. The photoconductive drums 20Y, 20C, and 20M are also surrounded by chargers 30Y, 30C, and 30M, developing devices 40Y, 40C, and 40M, primary transfer rollers 12Y, 12C, and 12M, and cleaners 50Y, 50C, and 50M in this order in the rotation direction D20 of the photoconductive drums 20Y, 20C, and 20M, respectively. After the charger 30K charges the photoconductive drum 20K, an optical writing device 8 writes an electrostatic latent image on the photoconductive drum 20K.

As the transfer belt 11 rotates in the rotation direction A1, the yellow, cyan, magenta, and black toner images formed on the photoconductive drums 20Y, 20C, 20M, and 20K, respectively, are primarily transferred successively onto the transfer belt 11, thus being superimposed on the same position on the transfer belt 11. For example, the primary transfer rollers 12Y, 12C, 12M, and 12K disposed opposite the photoconductive drums 20Y, 20C, 20M, and 20K via the transfer belt 11, respectively, and applied with an electric voltage primarily transfer the yellow, cyan, magenta, and black toner images formed on the photoconductive drums 20Y, 20C, 20M, and 20K at different times from the upstream photoconductive drum 20Y to the downstream photoconductive drum 20K in the rotation direction A1 of the transfer belt 11.

The photoconductive drums 20Y, 20C, 20M, and 20K are aligned in this order in the rotation direction A1 of the transfer belt 11. The photoconductive drums 20Y, 20C, 20M, and 20K are located in four image forming stations that form the yellow, cyan, magenta, and black toner images, respectively.

The image forming apparatus 100 includes the four image forming stations, a transfer belt unit 10, a secondary transfer roller 5, a belt cleaner 13, and the optical writing device 8. The transfer belt unit 10 is situated above and disposed opposite the photoconductive drums 20Y, 20C. 20M, and 20K. The transfer belt unit 10 incorporates the transfer belt 11 and the primary transfer rollers 12Y, 12C, 12M, and 12K. The secondary transfer roller 5 serves as a transferor disposed opposite the transfer belt 11 and driven and rotated in accordance with rotation of the transfer belt 11. The belt cleaner 13 is disposed opposite the transfer belt 11 to clean the transfer belt 11. The optical writing device 8 is situated below and disposed opposite the four image forming stations.

The optical writing device 8 includes a semiconductor laser serving as a light source, a coupling lens, an fθ lens, a troidal lens, a deflection mirror, and a rotatable polygon mirror serving as a deflector. The optical writing device 8 emits light beams Lb corresponding to the yellow, cyan, magenta, and black toner images to be formed on the photoconductive drums 20Y, 20C, 20M, and 20K, forming electrostatic latent images on the photoconductive drums 20Y, 20C, 20M, and 20K, respectively. FIG. 1 illustrates the light beam Lb irradiating the photoconductive drum 20K. Similarly, light beams irradiate the photoconductive drums 20Y, 20C, and 20M, respectively.

The image forming apparatus 100 further includes a sheet feeder 61 and a registration roller pair 4. The sheet feeder 61 incorporates a paper tray that loads a plurality of recording media S to be conveyed one by one to a secondary transfer nip formed between the transfer belt 11 and the secondary transfer roller 5. The registration roller pair 4 feeds a recording medium S conveyed from the sheet feeder 61 to the secondary transfer nip formed between the transfer belt 11 and the secondary transfer roller 5 at a given time when the yellow, cyan, magenta, and black toner images superimposed on the transfer belt 11 reach the secondary transfer nip. The image forming apparatus 100 further includes a sensor for detecting that a leading edge of the recording medium S reaches the registration roller pair 4.

The image forming apparatus 100 further includes a fixing device 200, an output roller pair 7, an output tray 17, and toner bottles 9Y, 9C, 9M, and 9K. The fixing device 200 fixes a color toner image formed by the yellow, cyan, magenta, and black toner images secondarily transferred from the transfer belt 11 onto the recording medium S thereon. The output roller pair 7 ejects the recording medium S bearing the fixed toner image onto an outside of the image forming apparatus 100, that is, the output tray 17. The output tray 17 is disposed atop the image forming apparatus 100 and stacks the recording medium S ejected by the output roller pair 7. The toner bottles 9Y, 9C, 9M, and 9K are situated below the output tray 17 and replenished with fresh yellow, cyan, magenta, and black toners, respectively.

The transfer belt unit 10 includes a driving roller 72 and a driven roller 73 over which the transfer belt 11 is looped, in addition to the transfer belt 11 and the primary transfer rollers 12Y, 12C, 12M, and 12K.

Since the driven roller 73 also serves as a tension applicator that applies tension to the transfer belt 11, a biasing member (e.g., a spring) biases the driven roller 73 against the transfer belt 11. The transfer belt unit 10, the primary transfer rollers 12Y, 12C, 12M, and 12K, the secondary transfer roller 5, and the belt cleaner 13 constitute a transfer device 71.

The sheet feeder 61 is situated in a lower portion of the image forming apparatus 100 and includes a feed roller 3 that contacts an upper side of an uppermost recording medium S of the plurality of recording media S loaded on the paper tray of the sheet feeder 61. As the feed roller 3 is driven and rotated counterclockwise in FIG. 1, the feed roller 3 feeds the uppermost recording medium S to the registration roller pair 4.

The belt cleaner 13 of the transfer device 71 includes a cleaning brush and a cleaning blade disposed opposite and contacting the transfer belt 11. The cleaning brush and the cleaning blade scrape a foreign substance such as residual toner particles off the transfer belt 11, removing the foreign substance from the transfer belt 11 and thereby cleaning the transfer belt 11. The belt cleaner 13 further includes a waste toner conveyer that conveys the residual toner particles removed from the transfer belt 11.

Figure 2:
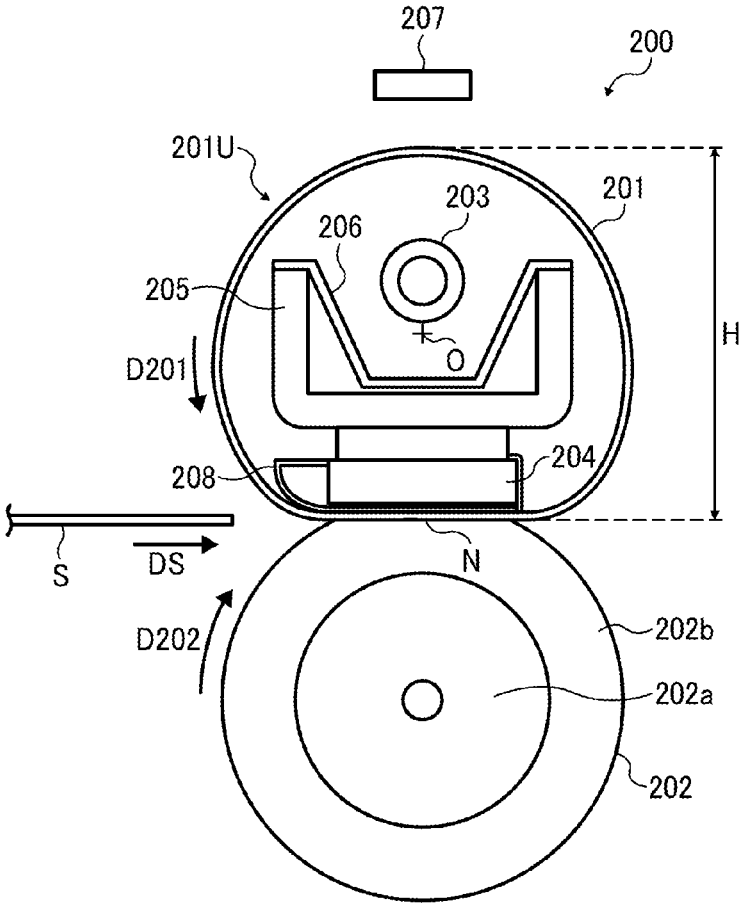
FIG. 2 is a schematic vertical sectional view of a fixing device according to a first example embodiment incorporated in the image forming apparatus shown in FIG. 1.

With reference to FIG. 2, a description is provided of a construction of the fixing device 200 according to a first example embodiment incorporated in the image forming apparatus 100 described above.

FIG. 2 is a schematic vertical sectional view of the fixing device 200. As shown in FIG. 2, the fixing device 200 (e.g., a fuser or a fusing unit) includes a fixing belt 201 serving as a fixing rotator or an endless belt formed into a loop and rotatable in a rotation direction D201; a pressure roller 202 serving as a pressure rotator rotatable in a rotation direction D202; a halogen heater 203 serving as a heater or a heat source disposed inside the loop formed by the fixing belt 201 to heat the fixing belt 201 directly with light irradiating an inner circumferential surface of the fixing belt 201; a nip formation pad 204 disposed inside the loop formed by the fixing belt 201 and pressing against the pressure roller 202 via the fixing belt 201 to form a fixing nip N between the fixing belt 201 and the pressure roller 202; a slide sheet 208 sandwiched between the nip formation pad 204 and the fixing belt 201; a support 205 disposed inside the loop formed by the fixing belt 201 and contacting and supporting the nip formation pad 204; a reflector 206 disposed inside the loop formed by the fixing belt 201 to reflect light radiated from the halogen heater 203 toward the fixing belt 201; and a temperature sensor 207 disposed opposite an outer circumferential surface of the fixing belt 201 to detect the temperature of the fixing belt 201. The fixing belt 201 and the components disposed inside the loop formed by the fixing belt 201, that is, the halogen heater 203, the nip formation pad 204, the support 205, the reflector 206, and the slide sheet 208, may constitute a belt unit 201U separably coupled with the pressure roller 202.

A detailed description is now given of a configuration of the nip formation pad 204.

The nip formation pad 204 situated inside the loop formed by the fixing belt 201 presses against the pressure roller 202 disposed opposite the nip formation pad 204 via the fixing belt 201 to form the fixing nip N between the fixing belt 201 and the pressure roller 202. As the fixing belt 201 rotates in the rotation direction D201, the inner circumferential surface of the fixing belt 201 slides over the nip formation pad 204 directly or indirectly via the slide sheet 208. As shown in FIG. 2, the fixing nip N is planar. Alternatively, the fixing nip N may be contoured into a recess or other shapes. If the fixing nip N defines the recess, the recessed fixing nip N directs the leading edge of the recording medium S toward the pressure roller 202 as the recording medium S is discharged from the fixing nip N, facilitating separation of the recording medium S from the fixing belt 201 and suppressing jamming of the recording medium S.

A detailed description is now given of a construction of the fixing belt 201.

The fixing belt 201 is an endless belt or film made of metal such as nickel and SUS stainless steel or resin such as polyimide. The fixing belt 201 is constructed of a base layer and a release layer. The release layer constituting an outer surface layer is made of tetrafluoroethylene-perfluoroalkylvinylether copolymer (PFA), polytetrafluoroethylene (PTFE), or the like to facilitate separation of toner of the toner image on the recording medium S from the fixing belt 201. An elastic layer may be sandwiched between the base layer and the release layer and made of silicone rubber or the like. If the fixing belt 201 does not incorporate the elastic layer, the fixing belt 201 has a decreased thermal capacity that improves fixing property of being heated quickly to a desired fixing temperature at which the toner image is fixed on the recording medium S. However, as the pressure roller 202 and the fixing belt 201 sandwich and press the toner image on the recording medium S passing through the fixing nip N, slight surface asperities of the fixing belt 201 may be transferred onto the toner image on the recording medium 5, resulting in variation in gloss of the solid toner image that may appear as an orange peel image on the recording medium S. To address this circumstance, the elastic layer made of silicone rubber has a thickness not smaller than about 100 micrometers. As the elastic layer deforms, the elastic layer absorbs slight surface asperities of the fixing belt 201, preventing formation of the faulty orange peel image.

A detailed description is now given of a configuration of the support 205.

The support 205 (e.g., a stay) that supports the nip formation pad 204 is situated inside the loop formed by the fixing belt 201. As the nip formation pad 204 receives pressure from the pressure roller 202, the support 205 supports the nip formation pad 204 to prevent bending of the nip formation pad 204 and produce an even nip length in a recording medium conveyance direction DS throughout the entire width of the fixing belt 201 in an axial direction thereof. The support 205 is mounted on and held by flanges serving as a holder at both lateral ends of the support 205 in a longitudinal direction thereof parallel to the axial direction of the fixing belt 201, respectively, thus being positioned inside the fixing device 200.

A detailed description is now given of a configuration of the reflector 206.

The reflector 206 interposed between the halogen heater 203 and the support 205 reflects light radiated from the halogen heater 203 to the reflector 206 toward the fixing belt 201, preventing the support 205 from being heated by the halogen heater 203 and thereby reducing waste of energy. Alternatively, instead of the reflector 206, an opposed face of the support 205 disposed opposite the halogen heater 203 may be treated with insulation or mirror finish to reflect light radiated from the halogen heater 203 to the support 205 toward the fixing belt 201. The halogen heater 203 serves as a heater for heating the fixing belt 201. Alternatively, the heater for heating the fixing belt 201 may be an induction heater (IH), a resistance heat generator, a carbon heater, or the like.

A detailed description is now given of a construction of the pressure roller 202.

The pressure roller 202 is constructed of a cored bar 202*a*, an elastic rubber layer 202*b* coating the cored bar 202*a*, and a surface release layer coating the elastic rubber layer 202*b* and made of PFA or PTFE to facilitate separation of the recording medium S from the pressure roller 202. As a driving force generated by a driver (e.g., a motor) situated inside the image forming apparatus 100 depicted in FIG. 1 is transmitted to the pressure roller 202 through a gear train, the pressure roller 202 rotates in the rotation direction D202. A spring or the like presses the pressure roller 202 against the nip formation pad 204 via the fixing belt 201. As the spring presses and deforms the elastic rubber layer 202*b* of the pressure roller 202, the pressure roller 202 produces the fixing nip N having a given length in the recording medium conveyance direction DS. The pressure roller 202 may be a hollow roller or a solid roller. If the pressure roller 202 is a hollow roller, a heater such as a halogen heater may be disposed inside the hollow roller. The elastic rubber layer 202*b* may be made of solid rubber. Alternatively, if no heater or heat source is situated inside the pressure roller 202, the elastic rubber layer 202*b* may be made of sponge rubber. The sponge rubber is more preferable than the solid rubber because it has an increased insulation that draws less heat from the fixing belt 201.

As the pressure roller 202 rotates in the rotation direction D202, the fixing belt 201 rotates in the rotation direction D201 in accordance with rotation of the pressure roller 202 by friction therebetween. According to the first example embodiment, as the driver drives and rotates the pressure roller 202, a driving force of the driver is transmitted from the pressure roller 202 to the fixing belt 201 at the fixing nip N, thus rotating the fixing belt 201 by friction between the pressure roller 202 and the fixing belt 201. Alternatively, the driver may also be connected to the fixing belt 201 to drive and rotate the fixing belt 201. At the fixing nip N, the fixing belt 201 rotates as it is sandwiched between the pressure roller 202 and the nip formation pad 204; at a circumferential span of the fixing belt 201 other than the fixing nip N, the fixing belt 201 rotates as it is guided by the flange serving as the holder at each lateral end of the fixing belt 201 in the axial direction thereof.

With the construction described above, the fixing device 200 attaining quick warm-up is manufactured at reduced costs.

A description is provided of a construction of a referential fixing device 200R.

Figure 3:
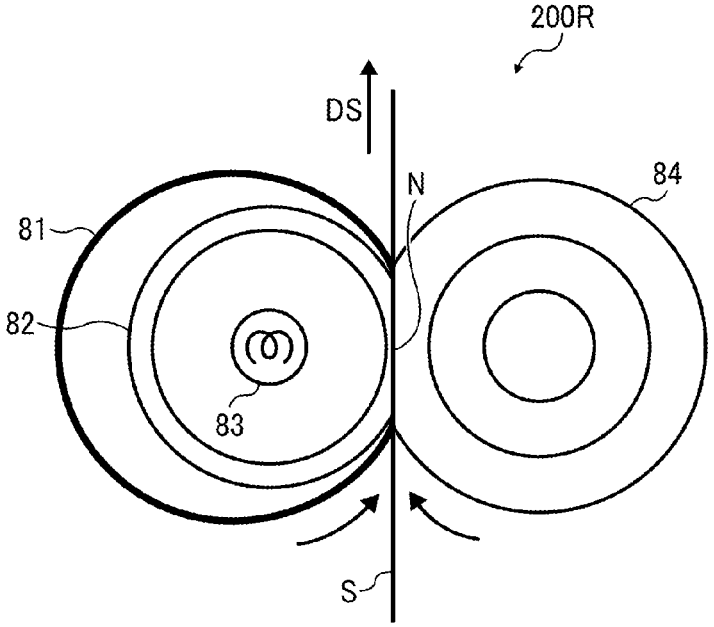
FIG. 3 is a schematic vertical sectional view of a referential fixing device.

FIG. 3 is a schematic vertical sectional view of the referential fixing device 200R. As shown in FIG. 3, the referential fixing device 200R includes a tubular metal thermal conductor 82 stationarily disposed inside a loop formed by an endless belt 81. As the endless belt 81 rotates counterclockwise in FIG. 3, the metal thermal conductor 82 guides the endless belt 81. As a heater 83 situated inside the metal thermal conductor 82 heats the metal thermal conductor 82, the metal thermal conductor 82 in turn heats the endless belt 81. A pressure roller 84 is pressed against the metal thermal conductor 82 via the endless belt 81 to form a fixing nip N between the endless belt 81 and the pressure roller 84. As the pressure roller 84 rotates clockwise in FIG. 3, the endless belt 81 rotates counterclockwise in accordance with rotation of the pressure roller 84. Hence, the metal thermal conductor 82 heats the endless belt 81 entirely, shortening a first print time taken after an image forming apparatus incorporating the referential fixing device 200R receives a print job in a standby mode until the image forming apparatus outputs a print through warming-up of the referential fixing device 200R and a printing process and overcoming shortage of heat that may occur when the endless belt 81 rotates at high speed.

However, in order to save energy and shorten the first print time further, the referential fixing device 200R is requested to improve heating efficiency in heating the endless belt 81 further. To address this request, the heater 83 may heat the endless belt 81 directly, not through the metal thermal conductor 82. Accordingly, the heater 83 heats the endless belt 81 effectively, decreasing power consumption and shortening the first print time from the standby mode. Additionally, elimination of the metal thermal conductor 82 reduces manufacturing costs.

A direct heating method in which the heater 83 heats the endless belt 81 directly improves heating efficiency in heating the endless belt 81 compared to an indirect heating method in which the heater 83 heats the endless belt 81 through the metal thermal conductor 82. However, in the direct heating method, the heater 83 configured to heat the endless belt 81 entirely may unnecessarily heat a component other than the endless belt 81 (e.g., a stay supporting the heater 83), degrading heating efficiency in heating the endless belt 81 and wasting power.

Figure 4A:
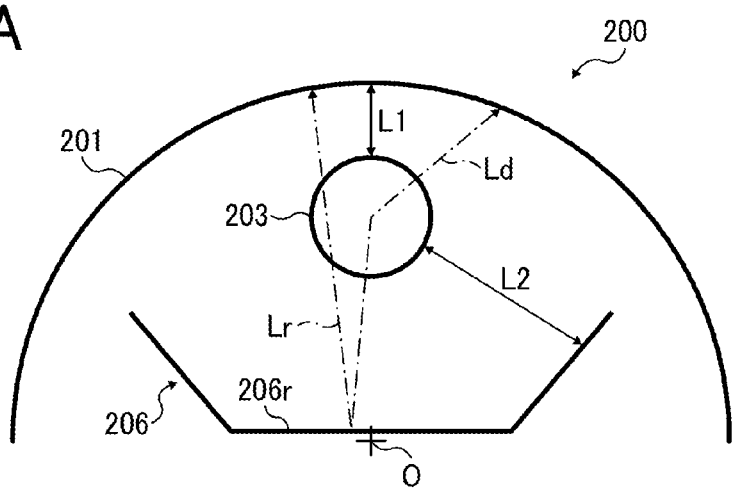
FIG. 4A is a partial schematic vertical sectional view of the fixing device shown in FIG. 2 for explaining a first example configuration thereof.
Figure 4B:
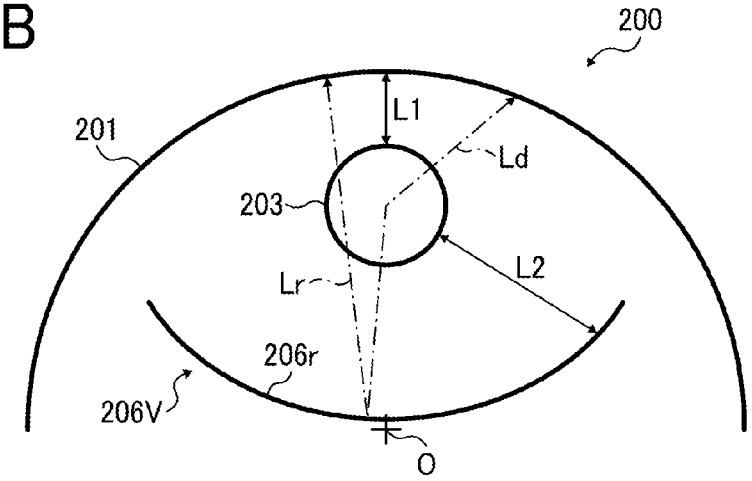
FIG. 4B is a partial schematic vertical sectional view of the fixing device shown in FIG. 2 illustrating a reflector installable therein.

With reference to FIGS. 4A and 4B, a description is provided of a first example configuration of the fixing device 200.

FIG. 4A is a partial schematic vertical sectional view of the fixing device 200 for explaining the first example configuration thereof. FIG. 4B is a partial schematic vertical sectional view of the fixing device 200 illustrating a variation of the reflector 206. As shown in FIGS. 4A and 4B, the halogen heater 203 is spaced apart from the fixing belt 201 with an interval L1 therebetween, that is, a shortest distance between the halogen heater 203 and the fixing belt 201. That is, the interval L1 is provided between an outer circumferential surface of the halogen heater 203 and the inner circumferential surface of the fixing belt 201. The inner circumferential surface of the fixing belt 201 reflects light emitted by the halogen heater 203 at a reflectance not greater than about 5 percent. Thus, the fixing belt 201 barely reflects the light radiated from the halogen heater 203 and therefore absorbs the light. Accordingly, as the fixing belt 201 absorbs the light, the temperature of the fixing belt 201 increases.

The reflector 206 has a uniform shape in the axial direction of the fixing belt 201 perpendicular to the recording medium conveyance direction DS depicted in FIG. 2. The reflector 206 is constructed of a plurality of planes as shown in a cross-section in FIG. 4A. As a variation of the reflector 206, a reflector 206V is constructed of a curve as shown in a cross-section in FIG. 4B. Each of the reflectors 206 and 206V includes a reflection face 206*r* disposed opposite the halogen heater 203. For example, the reflection face 206*r* has a reflectance of about 95 percent. The reflectors 206 and 206V reflect most of light emitted by the halogen heater 203 thereto. However, the reflectors 206 and 206V absorb about 5 percent of light irradiating the reflectors 206 and 206V, resulting in temperature increase of the reflectors 206 and 206V. The light absorbed by the reflectors 206 and 206V is not used to heat the fixing belt 201, resulting in waste of the light.

As light is transmitted through a glass tube of the halogen heater 203, the glass tube absorbs about 5 percent of the light. The light absorbed by the glass tube is not used to heat the fixing belt 201, resulting in waste of the light. For example, light emitted by the halogen heater 203 is struck against and reflected by the reflectors 206 and 206V and returned to and transmitted through the halogen heater 203, causing waste of the light.

As shown in FIGS. 4A and 4B, each of the reflectors 206 and 206V is spaced apart from the halogen heater 203 with an interval L2 therebetween, that is, a shortest distance between the halogen heater 203 and each of the reflectors 206 and 206V. That is, the interval L2 is provided between the outer circumferential surface of the halogen heater 203 and an inner circumferential surface of each of the reflectors 206 and 206V. The interval L2 is greater than the interval L1.

The interval L1 is minimized such that the halogen heater 203 does not contact the fixing belt 201 to increase direct light Ld irradiating the fixing belt 201 directly from the halogen heater 203 and thereby reduce waste of light emitted by the halogen heater 203. Each of the reflectors 206 and 206V is interposed between a rotation axis O of the fixing belt 201 and the halogen heater 203 with the increased interval L2 between the halogen heater 203 and each of the reflectors 206 and 206V. As shown in FIG. 2, the rotation axis O of the fixing belt 201 defines a rotation axis of the fixing belt 201 rotating in the rotation direction D201 or a half of a distance H from a center of the fixing nip N in the recording medium conveyance direction DS to a top of the fixing belt 201 in a vertical direction in FIG. 2 perpendicular to the recording medium conveyance direction DS.

Accordingly, each of the reflectors 206 and 206V depicted in FIGS. 4A and 4B decreases light irradiating each of the reflectors 206 and 206V from the halogen heater 203, reducing light wasted by absorption in each of the reflectors 206 and 206V. Additionally, each of the reflectors 206 and 206V decreases reflection light Lr emitted by the halogen heater 203, struck against and reflected by each of the reflectors 206 and 206V, and transmitted through the halogen heater 203 (hereinafter referred to as light reentering the halogen heater 203). Further, each of the reflectors 206 and 206V reflects the reflection light Lr to an increased circumferential span on the fixing belt 201 in a circumferential direction thereof to use light emitted by the halogen heater 203 to heat the fixing belt 201 effectively.

A description is provided of a second example configuration of the fixing device 200.

Figure 5:
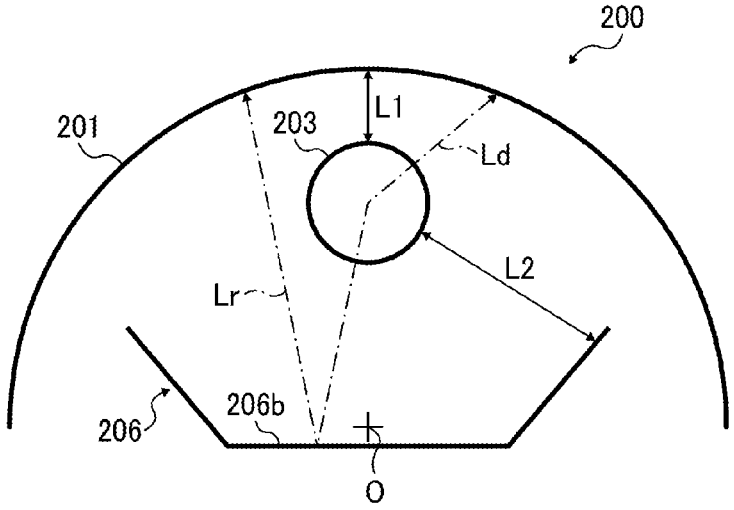
FIG. 5 is a partial schematic vertical sectional view of the fixing device shown in FIG. 2 for explaining a second example configuration thereof.

FIG. 5 is a partial schematic vertical sectional view of the fixing device 200 for explaining the second example configuration thereof. The second example configuration of the fixing device 200 is different from the first example configuration of the fixing device 200 shown in FIGS. 4A and 4B in that an interior portion 206*b* (e.g., a bottom portion) of the reflector 206 is interposed between the rotation axis O of the fixing belt 201 and the fixing nip N depicted in FIG. 2. That is, the interior portion 206*b* of the reflector 206 is disposed opposite the halogen heater 203 via the rotation axis O of the fixing belt 201. The interior portion 206*b* of the reflector 206 projects toward the nip formation pad 204 depicted in FIG. 2. Other configuration of the second example configuration of the fixing device 200 is equivalent to that of the first example configuration of the fixing device 200 shown in FIGS. 4A and 4B. For example, the second example configuration of the fixing device 200 may incorporate the curved reflector 206V depicted in FIG. 4B.

According to the second example configuration of the fixing device 200, the interior portion 206*b* of the reflector 206 is interposed between the rotation axis O of the fixing belt 201 and the fixing nip N. Accordingly, the interval L2 between the reflector 206 and the outer circumferential surface of the halogen heater 203 according to the second example configuration of the fixing device 200 is greater than the interval L2 according to the first example configuration of the fixing device 200, further increasing direct light Ld irradiating the fixing belt 201 directly from the halogen heater 203 and decreasing reflection light Lr irradiating the reflector 206.

Additionally, the reflector 206 further decreases the light reentering the halogen heater 203, that is, the reflection light Lr emitted by the halogen heater 203, struck against and reflected by the reflector 206, and transmitted through the halogen heater 203. Further, the reflector 206 reflects the reflection light Lr to a further increased circumferential span on the fixing belt 201 in the circumferential direction thereof to use the reflection light Lr from the halogen heater 203 to irradiate and heat the fixing belt 201 effectively.

Figure 6:
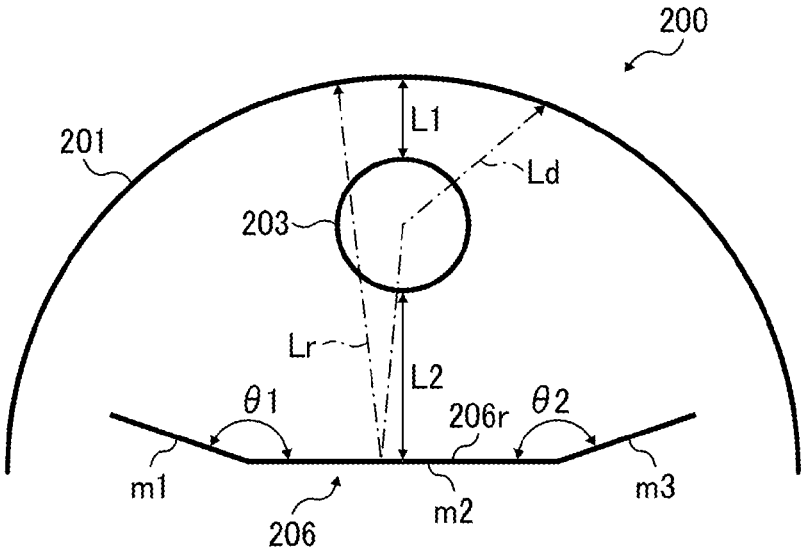
FIG. 6 is a partial schematic vertical sectional view of the fixing device shown in FIG. 2 for explaining the shape of the reflector.

With reference to FIG. 6, a description is provided of the shape of the reflector 206.

FIG. 6 is a partial schematic vertical sectional view of the fixing device 200 for explaining the shape of the reflector 206. As shown in FIGS. 4A and 5, the plurality of planes of the reflector 206 is contoured into a recess surrounding the halogen heater 203. For example, as shown in FIG. 6, the reflector 206 includes at least three planes, that is, a first plane m1, a second plane m2, and a third plane m3, uniformly extending in the axial direction of the fixing belt 201 perpendicular to the recording medium conveyance direction DS depicted in FIG. 2. The first plane m1, the second plane m2, and the third plane m3 surround the halogen heater 203. The reflector 206 includes three or more planes. FIG. 6 illustrates the reflector 206 constructed of the three planes, that is, the first plane m1, the second plane m2, and the third plane m3. Similarly, the curved reflector 206V shown in FIG. 4B includes the reflection face 206*r* that reflects the reflection light Lr, which is contoured into a recess surrounding the halogen heater 203.

As shown in FIG. 6, the halogen heater 203 is spaced apart from the fixing belt 201 with the interval L1 therebetween, that is, the shortest distance between the halogen heater 203 and the fixing belt 201. That is, the interval L1 is provided between the outer circumferential surface of the halogen heater 203 and the inner circumferential surface of the fixing belt 201. The reflector 206 is spaced apart from the halogen heater 203 with the interval L2 therebetween, that is, the shortest distance between the halogen heater 203 and the reflector 206. That is, the interval L2 is provided between the outer circumferential surface of the halogen heater 203 and the inner circumferential surface of the reflector 206. The interval L2 is greater than the interval L1.

The first plane m1 and the second plane m2 define a first angle θ1. The second plane m2 and the third plane m3 define a second angle θ2. Each of the first angle θ1 and the second angle θ2 is greater than 90 degrees and smaller than 180 degrees. Each of the first angle θ1 and the second angle θ2 defines an angle of the reflection face 206*r*. For example, each of the first angle θ1 and the second angle θ2 is close to 180 degrees.

Accordingly, the reflector 206 decreases reflection light Lr emitted by the halogen heater 203, struck against and reflected by the reflector 206, and struck against the reflector 206 again (hereinafter referred to as multiple reflections between the plurality of planes of the reflector 206), directing the reflection light Lr emitted by the halogen heater 203 and reflected by the reflector 206 to the fixing belt 201 so as to heat the fixing belt 201 effectively.

Figure 7:
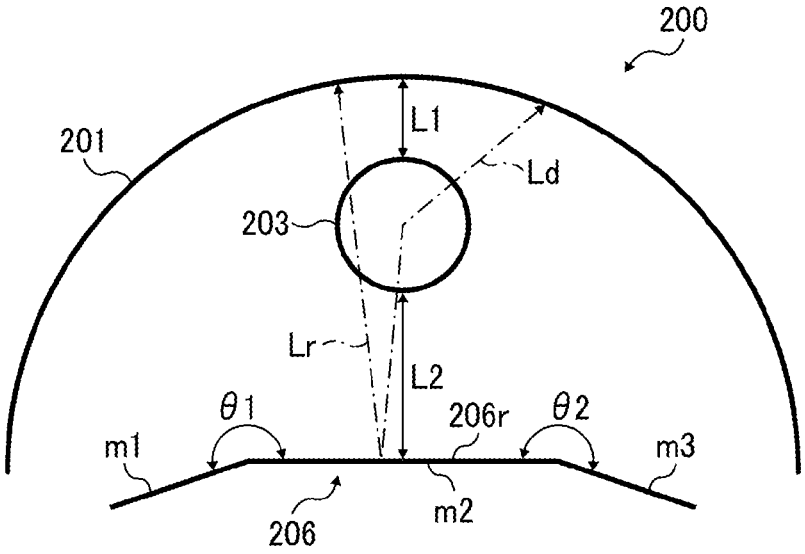
FIG. 7 is a partial schematic vertical sectional view of the fixing device shown in FIG. 2 for explaining a third example configuration thereof.

With reference to FIG. 7, a description is provided of a third example configuration of the fixing device 200.

FIG. 7 is a partial schematic vertical sectional view of the fixing device 200 for explaining the third example configuration thereof. The third example configuration of the fixing device 200 is different from the first example configuration of the fixing device 200 shown in FIGS. 4A and 4B and the second example configuration of the fixing device 200 shown in FIG. 5 in that the reflector 206 is contoured into a projection projecting toward the halogen heater 203. Other configuration of the third example configuration of the fixing device 200 is equivalent to that of the first example configuration of the fixing device 200 shown in FIGS. 4A and 4B and the second example configuration of the fixing device 200 shown in FIG. 5. For example, the third example configuration of the fixing device 200 may incorporate the curved reflector 206V depicted in FIG. 4B. FIG. 7 illustrates the reflector 206 constructed of the plurality of planes, that is, the first plane m1, the second plane m2, and the third plane m3.

For example, as shown in FIG. 7, the reflector 206 is contoured into the projection projecting toward the halogen heater 203 and includes at least three planes, that is, the first plane m1, the second plane m2, and the third plane m3 uniformly extending in the axial direction of the fixing belt 201. The first plane m1 and the second plane m2 define the first angle θ1. The second plane m2 and the third plane m3 define the second angle θ2. Each of the first angle θ1 and the second angle θ2 is greater than 180 degrees and smaller than 270 degrees. Each of the first angle θ1 and the second angle θ2 defines the angle of the reflection face 206*r*.

Accordingly, the reflector 206 eliminates the multiple reflections between the plurality of planes of the reflector 206, that is, the reflection light Lr emitted by the halogen heater 203, struck against and reflected by the reflector 206, and struck against the reflector 206 again. The first plane m1 and the third plane m3 reflect the reflection light Lr striking the reflector 206 toward an increased circumferential span on the fixing belt 201 in the circumferential direction thereof. Thus, the reflector 206 decreases the light reentering the halogen heater 203, that is, the reflection light Lr emitted by the halogen heater 203, struck against and reflected by the reflector 206, and transmitted through the halogen heater 203, directing the reflection light Lr emitted by the halogen heater 203 to the fixing belt 201 so as to irradiate and heat the fixing belt 201 effectively.

Figure 8:
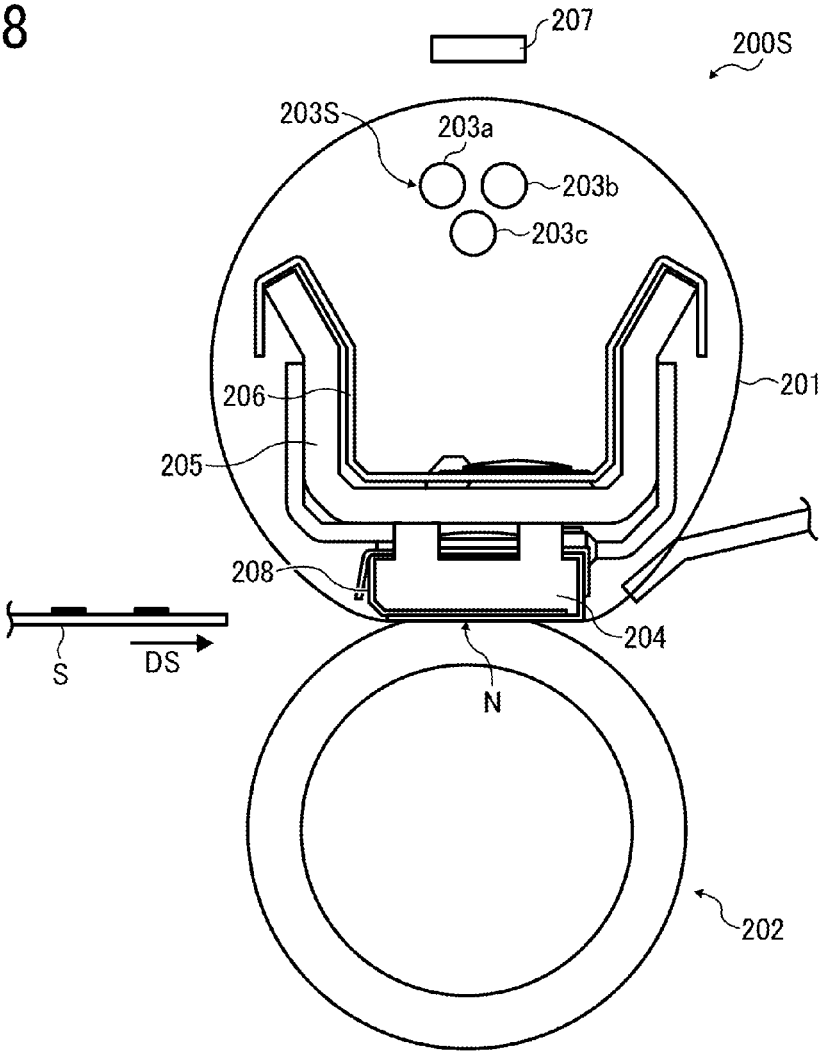
FIG. 8 is a vertical sectional view of a fixing device according to a second example embodiment of the present disclosure.
Figure 9:
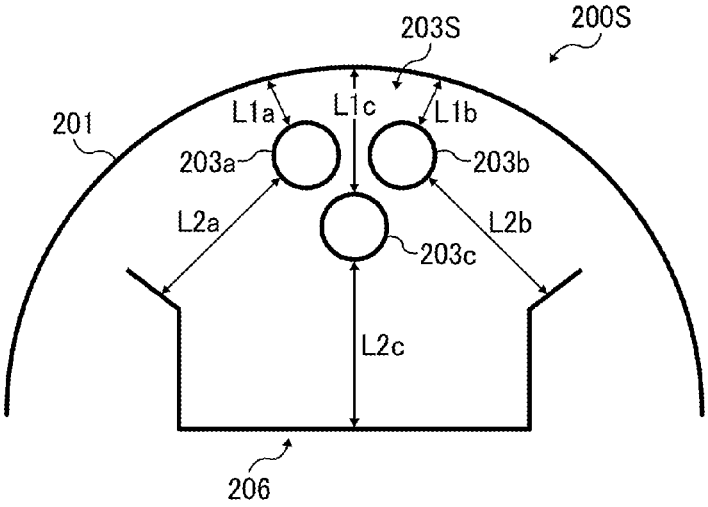
FIG. 9 is a partial schematic vertical sectional view of the fixing device shown in FIG. 8.

With reference to FIGS. 8 and 9, a description is provided of a construction of a fixing device 200S according to a second example embodiment.

FIG. 8 is a vertical sectional view of the fixing device 200S. The fixing device 200S according to the second example embodiment is different from the fixing device 200 according to the first example embodiment depicted in FIG. 2 in a construction of the heater. For example, the fixing device 200S according to the second example embodiment includes a halogen heater trio 203S serving as a heater or a heat source constructed of three halogen heaters 203*a*, 203*b*, and 203*c*. Other configuration of the fixing device 200S according to the second example embodiment is equivalent to the above-described configuration of the fixing device 200 according to the first example embodiment depicted in FIG. 2.

FIG. 9 is a partial schematic vertical sectional view of the fixing device 200S. As shown in FIG. 9, the halogen heater trio 203S includes the three heaters, that is, the halogen heaters 203*a*, 203*b*, and 203*c*. In order to heat recording media S of various sizes, the halogen heaters 203*a*, 203*b*, and 203*c* have a plurality of heat generation spans (e.g., a plurality of light-emitting spans) different from each other in the axial direction of the fixing belt 201, producing a heat generation distribution (e.g., a light-emitting distribution). The halogen heaters 203*a*, 203*b*, and 203*c* are selectively turned on according to a width of a recording medium S in the axial direction of the fixing belt 201, thus heating the fixing belt 201 effectively.

The halogen heater 203*a* is a first heater or a center heater being disposed opposite and heating an increased center of the fixing belt 201 in the axial direction thereof where an A4 size sheet in portrait orientation having a width of 210 mm is conveyed. The halogen heater 203*b* is a second heater or a lateral end heater being disposed opposite and heating a lateral end of the fixing belt 201 in the axial direction thereof outboard from the increased center of the fixing belt 201 in the axial direction thereof. The halogen heater 203*c* is a third heater or an A5 size heater being disposed opposite and heating a decreased center of the fixing belt 201 in the axial direction thereof where an A5 size sheet in portrait orientation having a width of 148 mm is conveyed.

With reference to FIG. 9, a description is provided of a configuration of the reflector 206 incorporated in the fixing device 200S according to the second example embodiment.

As shown in FIG. 9, the halogen heater 203*a* is spaced apart from the fixing belt 201 with an interval L1*a* therebetween, that is, a shortest distance between the halogen heater 203*a* and the fixing belt 201. That is, the interval L1*a* is provided between an outer circumferential surface of the halogen heater 203*a* and the inner circumferential surface of the fixing belt 201. The reflector 206 is spaced apart from the halogen heater 203*a* with an interval L2*a* therebetween, that is, a shortest distance between the halogen heater 203*a* and the reflector 206. That is, the interval L2*a* is provided between the outer circumferential surface of the halogen heater 203*a* and the inner circumferential surface of the reflector 206. The interval L2*a* is greater than the interval L1*a*.

Similarly, the halogen heater 203*b* is spaced apart from the fixing belt 201 with an interval L1*b* therebetween, that is, a shortest distance between the halogen heater 203*b* and the fixing belt 201. That is, the interval L1*b* is provided between an outer circumferential surface of the halogen heater 203*b* and the inner circumferential surface of the fixing belt 201. The reflector 206 is spaced apart from the halogen heater 203*b* with an interval L2*b* therebetween, that is, a shortest distance between the halogen heater 203*b* and the reflector 206. That is, the interval L2*b* is provided between the outer circumferential surface of the halogen heater 203*b* and the inner circumferential surface of the reflector 206. The interval L2*b* is greater than the interval L1*b*.

Similarly, the halogen heater 203*c* is spaced apart from the fixing belt 201 with an interval L1*c* therebetween, that is, a shortest distance between the halogen heater 203*c* and the fixing belt 201. That is, the interval L1*c* is provided between an outer circumferential surface of the halogen heater 203*c* and the inner circumferential surface of the fixing belt 201. The reflector 206 is spaced apart from the halogen heater 203*c* with an interval L2*c* therebetween, that is, a shortest distance between the halogen heater 203*c* and the reflector 206. That is, the interval L2*c* is provided between the outer circumferential surface of the halogen heater 203*c* and the inner circumferential surface of the reflector 206. The interval L2*c* is greater than the interval L1*c*.

The halogen heaters 203*a*, 203*b*, and 203*c* are spaced apart from the fixing belt 201 with the intervals L1*a*, L1*b*, and L1*c* therebetween and from the reflector 206 with the intervals L2*a*, L2*b*, and L2*c* therebetween, respectively, such that the intervals L2*a*, L2*b*, and L2*c* are greater than the intervals L1*a*, L1*b*, and L1*c*, respectively. Accordingly, even if recording media S (e.g., sheets) of various sizes are conveyed through the fixing device 200S, the halogen heaters 203*a*, 203*b*, and 203*c* and the reflector 206 emit and direct light to the fixing belt 201 effectively.

Alternatively, all of the halogen heaters 203*a*, 203*b*, and 203*c* may not attain the intervals L2*a*, L2*b*, and L2*c* being greater than the intervals L1*a*, L1*b*, and L1*c*, respectively. For example, even if only the halogen heater 203*a* serving as the first heater or the center heater for heating the A4 size sheet frequently used attains the interval L2*a* being greater than the interval L1*a*, the halogen heaters 203*a*, 203*b*, and 203*c* and the reflector 206 emit and direct light to the fixing belt 201 effectively while the A4 size sheet is conveyed through the fixing device 200S.

With reference to FIGS. 10, 11, 12A, 12B, 13A, and 13B, a description is provided of a construction of a fixing device 200T according to a third example embodiment.

Figure 10:
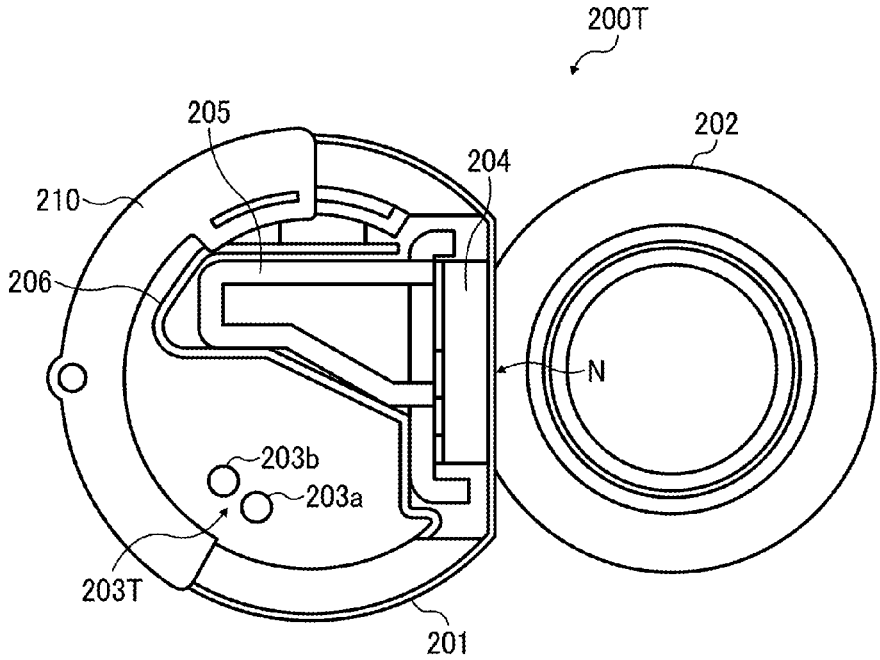
FIG. 10 is a vertical sectional view of a fixing device according to a third example embodiment of the present disclosure.

FIG. 10 is a vertical sectional view of the fixing device 200T. The fixing device 200T according to the third example embodiment is different from the fixing device 200 according to the first example embodiment depicted in FIG. 2 and the fixing device 200S according to the second example embodiment depicted in FIG. 8 in a construction of the heater. For example, the fixing device 200T according to the third example embodiment includes a halogen heater pair 203T serving as a heater or a heat source constructed of the two halogen heaters 203*a* and 203*b*. The fixing device 200T further includes a movable light shield 210 that shields the fixing belt 201 from the halogen heater pair 203T to prevent overheating of each lateral end of the fixing belt 201 in the axial direction thereof.

Figure 11:
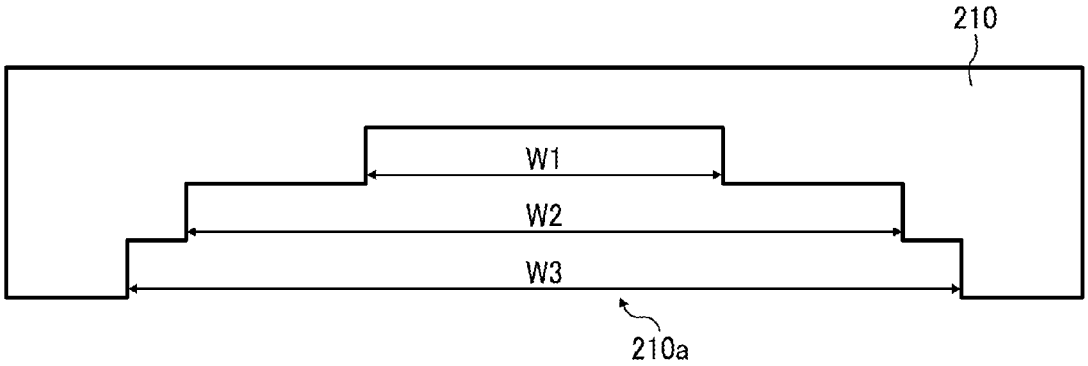
FIG. 11 is a plan view of a light shield incorporated in the fixing device shown in FIG. 10.

FIG. 11 is a plan view of the light shield 210. As shown in FIG. 11, the light shield 210 includes an aperture 210*a* serving as a non-shield portion that does not shield the fixing belt 201 from the halogen heater pair 203T. The aperture 210*a* has a plurality of widths in the axial direction of the fixing belt 201 that corresponds to a plurality of sizes of recording media S, that is, a width W1 corresponding to a width of a postcard, a width W2 corresponding to a width of a B4 size sheet, and a width W3 corresponding to a width of an A3 size sheet.

Figure 12A:
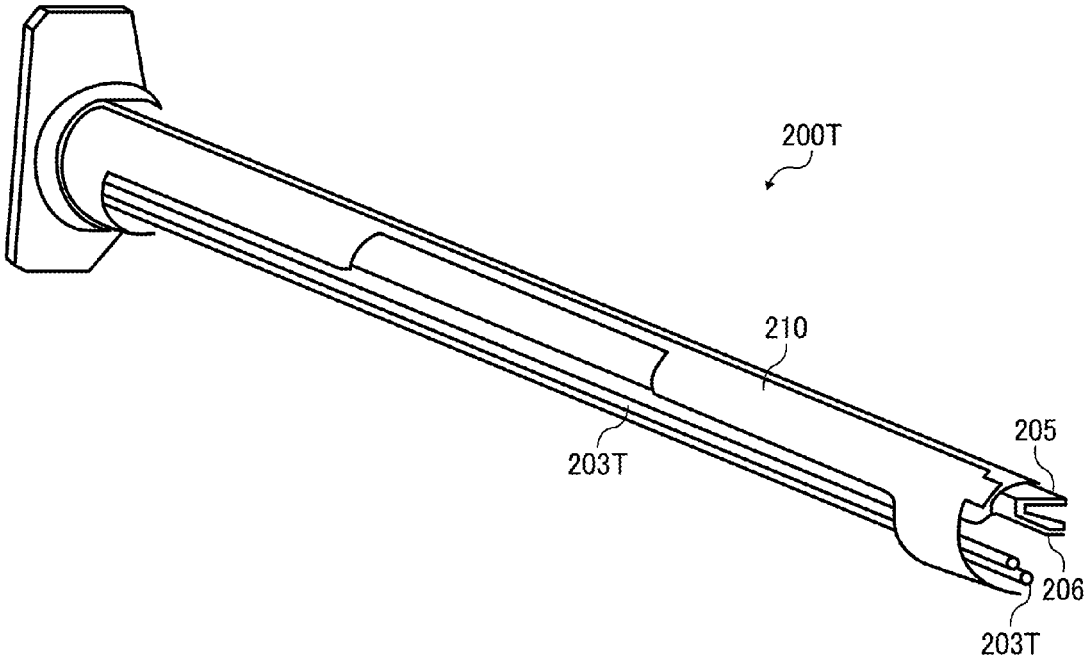
FIG. 12A is a partial perspective view of the fixing device shown in FIG. 10 illustrating the light shield shown in FIG. 11 situated at a non-shield position.
Figure 12B:
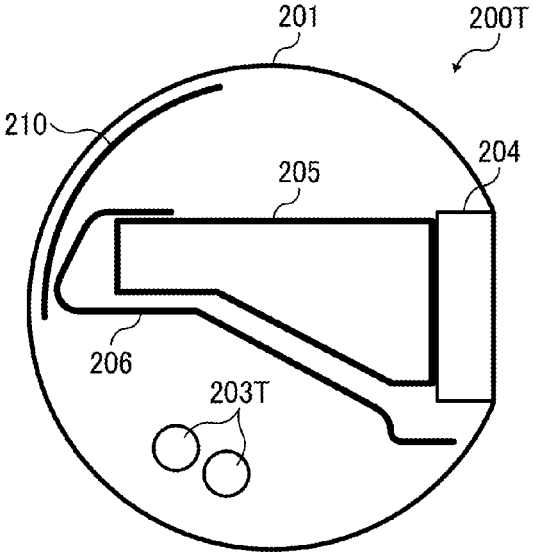
FIG. 12B is a partial vertical sectional view of the fixing device shown in FIG. 12A.
Figure 13A:
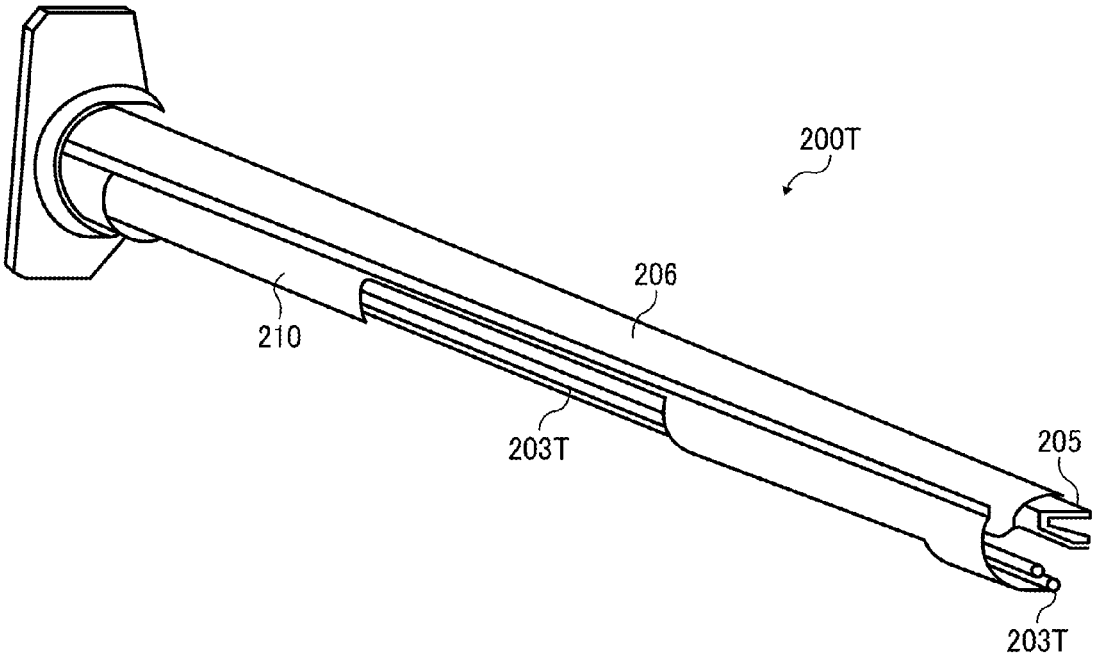
FIG. 13A is a partial perspective view of the fixing device shown in FIG. 10 illustrating the light shield shown in FIG. 11 situated at a shield position.
Figure 13B:
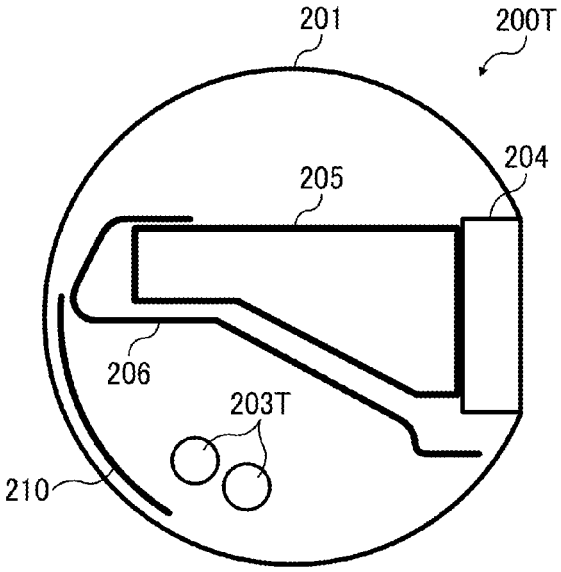
FIG. 13B is a partial vertical sectional view of the fixing device shown in FIG. 13A.

FIG. 12A is a partial perspective view of the fixing device 200T illustrating the light shield 210 situated at a non-shield position where the light shield 210 does not shield the fixing belt 201 from the halogen heater pair 203T. FIG. 12B is a partial vertical sectional view of the fixing device 200T illustrating the light shield 210 situated at the non-shield position. FIG. 13A is a partial perspective view of the fixing device 200T illustrating the light shield 210 situated at a shield position where the light shield 210 shields the fixing belt 201 from the halogen heater pair 203T. FIG. 13B is a partial vertical sectional view of the fixing device 200T illustrating the light shield 210 situated at the shield position.

As shown in FIGS. 12A, 12B, 13A, and 13B, the light shield 210 is rotatable along the inner circumferential surface of the fixing belt 201 without contacting the fixing belt 201. The light shield 210 is selectively rotated to a plurality of shield positions according to the width of the recording medium S conveyed through the fixing device 200T, shielding the fixing belt 201 from the halogen heater pair 203T in an axial span on the fixing belt 201 where heating of the fixing belt 201 is unnecessary. FIGS. 12A and 12B illustrate the light shield 210 situated at the non-shield position when the A3 size sheet is conveyed. FIGS. 13A and 13B illustrate the light shield 210 situated at the shield position when the postcard is conveyed.

Even if a plurality of small recording media S having a decreased width is conveyed through the fixing device 200T continuously, the light shield 210 shields the fixing belt 201 from the halogen heater pair 203T, preventing overheating of each lateral end of the fixing belt 201 in the axial direction thereof where the small recording media S are not conveyed and disinvolving a control to eliminate an overheated span on the fixing belt 201 in the axial direction thereof that may degrade productivity of the fixing device 200T. Hence, the fixing device 200T incorporates the two halogen heaters 203*a* and 203*b* decreased compared to the three halogen heaters 203*a*, 203*b*, and 203*c* of the fixing device 200S shown in FIG. 8.

Also in the fixing device 200T according to the third example embodiment, each of the two halogen heaters 203*a* and 203*b* of the halogen heater pair 203T attains the interval L2 between each of the halogen heaters 203*a* and 203*b* and the reflector 206 that is greater than the interval L1 between each of the halogen heaters 203*a* and 203*b* and the fixing belt 201. Accordingly, even if recording media S (e.g., sheets) of various sizes are conveyed through the fixing device 200T, the halogen heater pair 203T and the reflector 206 direct light to the fixing belt 201 effectively.

With reference to Table 1 below, a description is provided of an experiment to compare the fixing devices 200, 200S, and 200T according to the example embodiments described above with a comparative fixing device. The experiment measures power consumption during a fixing operation to examine advantages of the fixing devices 200, 200S, and 200T. The fixing devices 200, 200S, and 200T and the comparative fixing device used for the experiment perform fixing on up to 60 sheets per minute. The fixing devices 200, 200S, and 200T and the comparative fixing device have an identical configuration except for a relation among a heater (e.g., the halogen heater 203, the halogen heater trio 203S, the halogen heater pair 203T, and a heater of the comparative fixing device), a fixing rotator or an endless belt (e.g., the fixing belt 201), and a reflector (e.g., the reflectors 206 and 206V). In the description of the experiment below, the halogen heater 203, the halogen heater trio 203S, and the halogen heater pair 203T are referred to as the halogen heater 203. The reflectors 206 and 206V are referred to as the reflector 206. A loop diameter of the fixing belt 201 is 30 mm.

A fixing device A is the comparative fixing device, that is, a conventional fixing device, in which the interval L1 between the halogen heater 203 and the fixing belt 201 is 4 mm, the interval L2 between the halogen heater 203 and the reflector 206 is 2.5 mm, and the interval L2 is greater than the interval L1.

A fixing device B is any one of the fixing devices 200, 200S, and 200T in which the interval L1 between the halogen heater 203 and the fixing belt 201 is 2.5 mm, the interval L2 between the halogen heater 203 and the reflector 206 is 4 mm, and the interval L2 is greater than the interval L1.

A fixing device C is any one of the fixing devices 200, 200S, and 200T in which the interval L1 between the halogen heater 203 and the fixing belt 201 is 2.5 mm, the interval L2 between the halogen heater 203 and the reflector 206 is 4 mm, the interval L2 is greater than the interval L1, and the interior portion 206*b* of the reflector 206 is interposed between the rotation axis O of the fixing belt 201 and the fixing nip N as shown in FIG. 5.

A fixing device D is any one of the fixing devices 200, 200S, and 200T in which the reflector 206 includes a plurality of planes where one plane and a contiguous plane define an increased angle compared to the fixing device B as shown in FIG. 6. In the fixing device D, the interval L1 between the halogen heater 203 and the fixing belt 201 is 2.5 mm, the interval L2 between the halogen heater 203 and the reflector 206 is 4 mm, the interval L2 is greater than the interval L1, and each of the first angle θ1 and the second angle θ2 is 1.50 degrees.

A fixing device E is the fixing device 200 having the third example configuration of the first example embodiment shown in FIG. 7 that incorporates the reflector 206 contoured into the projection projecting toward the halogen heater 203. In the fixing device E, the interval L1 between the halogen heater 203 and the fixing belt 201 is 2.5 mm, the interval L2 between the halogen heater 203 and the reflector 206 is 4 mm, the interval L2 is greater than the interval L1, and each of the first angle θ1 and the second angle θ2 is 210 degrees.

A fixing device F is any one of the fixing devices 200, 200S, and 200T in which the interval L1 between the halogen heater 203 and the fixing belt 201 is 2.5 mm, the interval L2 between the halogen heater 203 and the reflector 206 is 6 mm, the interval L2 is greater than the interval L1, and each of the first angle θ1 and the second angle θ2 is 150 degrees. Additionally, in the fixing device F, the interior portion 206*b* of the reflector 206 is interposed between the rotation axis O of the fixing belt 201 and the fixing nip N as shown in FIG. 5.

A fixing device G is any one of the fixing devices 200, 200S, and 200T in which the interval L1 between the halogen heater 203 and the fixing belt 201 is 2.5 mm, the interval L2 between the halogen heater 203 and the reflector 206 is 6 mm, the interval L2 is greater than the interval L1, and each of the first angle θ1 and the second angle θ2 is 210 degrees. Additionally, in the fixing device G, the interior portion 206*b* of the reflector 206 is interposed between the rotation axis O of the fixing belt 201 and the fixing nip N as shown in FIG. 5.

Table 1 below shows a result of a measurement for measuring power consumed by the fixing devices A to G installed in the image forming apparatus 100 depicted in FIG. 1 after the image forming apparatus 100 is powered on until the image forming apparatus 100 finishes printing on 50 sheets of A4 size. As shown in Table 1, the fixing device B reduces power consumption by 3 percent compared to the comparative fixing device A. The fixing devices C to G reduce power consumption by about 5 percent to about 9 percent compared to the comparative fixing device A.

TABLE 1

| Fixing device | A | B | C | D | E | F | G |
|---|---|---|---|---|---|---|---|
| Power consumption (Wh) | 17 | 16.5 | 16.1 | 16.1 | 15.8 | 15.7 | 15.5 |
| Power reduction rate (%) | — | 2.9 | 5.3 | 5.3 | 7.1 | 7.6 | 8.8 |

A description is provided of advantages of the fixing devices 200, 200S, and 200T.

As shown in FIGS. 2, 8, and 10, a fixing device (e.g., the fixing devices 200, 200S, and 200T) includes a fixing rotator (e.g., the fixing belt 201) rotatable in the rotation direction D201; a heater (e.g., the halogen heater 203, the halogen heater trio 203S, and the halogen heater pair 203T) disposed opposite the fixing rotator to heat the fixing rotator; a nip formation pad (e.g., the nip formation pad 204) disposed inside a loop formed by the fixing rotator; a pressure rotator (e.g., the pressure roller 202) pressed against the nip formation pad via the fixing rotator to form the fixing nip N between the fixing rotator and the pressure rotator; and a reflector (e.g., the reflector 206) disposed inside the loop formed by the fixing rotator to reflect light radiated from the heater to the fixing rotator. As shown in FIGS. 4A, 4B, 5, 6, 7, and 9, a first interval (e.g., the intervals L1, L1*a*, L1*b*, and L1*c*) between the heater and the fixing rotator is smaller than a second interval (e.g., the intervals L2, L2*a*, L2*b*, and L2*c*) between the heater and the reflector.

As described above, the fixing device attains the first interval between the heater and the fixing rotator that is smaller than the second interval between the heater and the reflector, increasing the direct light Ld irradiating the fixing rotator from the heater, decreasing the reflection light Lr striking the reflector, and thereby reducing waste of light. Accordingly, light radiated from the heater reaches and heats the fixing rotator effectively. Consequently, effective heat conduction from the heater to the fixing rotator suppresses waste of energy, saving energy further and shortening the first print time.

As shown in FIG. 5, the interior portion 206*b* of the reflector is interposed between the rotation axis O of the fixing rotator and the fixing nip N to increase the distance between the heater and the reflector, thus increasing heat absorbed into the fixing rotator and decreasing heat absorbed into the reflector. Additionally, the reflector decreases the light reentering the heater, that is, the reflection light Lr emitted by the heater, struck against and reflected by the reflector, and transmitted through the heater, thus heating the fixing rotator effectively. Accordingly, the reflector and the heater are installed in the fixing device readily, saving energy, enhancing heat conduction from the heater to the fixing rotator, and reducing power consumption compared to the comparative fixing device A. Additionally, the reflector shortens the first print time from the standby mode.

As shown in FIGS. 4A, 4B, 5, 6, and 9, the reflector is contoured in a cross-section perpendicular to an axial direction of the fixing rotator into the recess disposed opposite the heater. As shown in FIG. 6, the reflector includes at least three planes (e.g., the first plane m1, the second plane m2, and the third plane m3) contiguous to each other and surrounding the heater. The angle defined by the adjacent planes of the at least three planes disposed opposite the heater is greater than 90 degrees and smaller than 180 degrees, producing the first interval between the heater and the fixing rotator that is smaller than the second interval between the heater and the reflector readily. Further, the reflector reduces the multiple reflections between the plurality of planes of the reflector that may occur when light emitted by the heater is struck against and reflected by the reflector and struck against the reflector again, facilitating effective irradiation of the fixing rotator with light and heat conduction from the heater to the fixing rotator. Accordingly, the reflector saves energy and enhances heat conduction from the heater to the fixing rotator, reducing power consumption compared to the comparative fixing device A. Additionally, the reflector shortens the first print time from the standby mode.

As shown in FIG. 7, the reflector is contoured in a cross-section perpendicular to the axial direction of the fixing rotator into the projection disposed opposite the heater. The reflector includes at least three planes (e.g., the first plane m1, the second plane m2, and the third plane m3) contiguous to each other. The angle defined by the adjacent planes of the at least three planes disposed opposite the heater is greater than 180 degrees and smaller than 270 degrees, eliminating the multiple reflections between the plurality of planes of the reflector that may occur when light emitted by the heater is struck against and reflected by the reflector and struck against the reflector again. Further, the reflector reduces the light reentering the heater, that is, light emitted by the heater, struck against and reflected by the reflector, struck against and reflected by an increased span on the fixing rotator, and transmitted through the heater, thus directing the light from the heater to the fixing rotator to heat the fixing rotator effectively. Accordingly, the reflector saves energy and enhances heat conduction from the heater to the fixing rotator, reducing power consumption compared to the comparative fixing device A. Additionally, the reflector shortens the first print time from the standby mode.

As shown in FIGS. 8 and 10, the fixing device includes a plurality of heaters (e.g., the halogen heater trio 203S including the halogen heaters 203*a*, 203*b*, and 203*c* and the halogen heater pair 203T including the halogen heaters 203*a* and 203*b*). Each of the heaters attains the first interval being smaller than the second interval. Thus, even if the fixing device includes the plurality of heaters, light emitted by the heater irradiates and heats the fixing rotator effectively.

As shown in FIG. 10, the fixing device includes a movable light shield (e.g., the light shield 210) that shields the fixing rotator from the heater and is selectively movable to a plurality of shield positions according to the size of the recording medium S. Thus, the light shield prohibits light emitted by the heater from irradiating an outboard span on the fixing rotator outboard from the recording medium S in the axial direction of the fixing rotator where heating is unnecessary. Accordingly, even after a plurality of small recording media S is conveyed over the fixing rotator continuously, the light shield prevents overheating of the outboard span on the fixing rotator where the small recording media S are not conveyed, suppressing degradation in productivity of the fixing device. Additionally, the light shield prevents hot offset of toner of a toner image on the recording medium S.

The present disclosure is not limited to the details of the example embodiments described above and various modifications and improvements are possible. For example, the number of the heaters and the location of the heaters may be changed arbitrarily. The material of a belt or a film used as the fixing rotator, the configuration of the pressure rotator, and the like may be modified.

Further, the configuration of the image forming apparatus 100 may be modified arbitrarily. For example, FIG. 1 illustrates the image forming apparatus 100 using toners in four colors. Alternatively, the image forming apparatus 100 may be a full color image forming apparatus using toners in three colors, a multicolor image forming apparatus using toners in two colors, or a monochrome image forming apparatus using toner in a single color.

According to the example embodiments described above, the fixing belt 201 serves as a fixing rotator. Alternatively, a fixing film, a fixing sleeve, a fixing roller, or the like may be used as a fixing rotator. Further, the pressure roller 202 serves as a pressure rotator. Alternatively, a pressure belt or the like may be used as a pressure rotator.

The present disclosure has been described above with reference to specific example embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative example embodiments may be combined with each other and/or substituted for each other within the scope of the present disclosure.

What is claimed is:

1. A fixing device comprising:

a fixing rotator rotatable in a given direction of rotation;

a pressure rotator pressed against the fixing rotator to form a fixing nip therebetween, through which a recording medium is conveyed;

one or more heaters disposed opposite the fixing rotator with a first minimized interval between each and every heater in the fixing device and the fixing rotator to heat the fixing rotator; and a reflector to reflect light emitted by the one or more heaters to the fixing rotator, the reflector disposed opposite the one or more heaters with a second minimized interval between each of the one or more heaters and the reflector that is greater than the first minimized interval.

2. The fixing device according to claim 1, wherein the one or more heaters and the reflector are disposed inside the fixing rotator.

3. The fixing device according to claim 2, wherein the reflector includes an interior portion interposed between a rotation axis of the fixing rotator and the fixing nip.

4. The fixing device according to claim 3, further comprising a nip formation pad pressing against the pressure rotator via the fixing rotator to form the fixing nip, wherein the interior portion of the reflector projects toward the nip formation pad.

5. The fixing device according to claim 2, wherein the reflector is interposed between a rotation axis of the fixing rotator and the one or more heaters.

6. The fixing device according to claim 1, wherein the reflector includes:

a first plane;

a second plane contiguous to the first plane; and a third plane contiguous to the second plane.

7. The fixing device according to claim 6, wherein the first plane, the second plane, and the third plane are contoured into a recess disposed opposite the first heater.

8. The fixing device according to claim 7, wherein the first plane and the second plane define a first angle and the second plane and the third plane define a second angle, each of the first angle and the second angle being greater than 90 degrees and smaller than 180 degrees.

9. The fixing device according to claim 6, wherein the first plane, the second plane, and the third plane are contoured into a projection disposed opposite the first heater.

10. The fixing device according to claim 9, wherein the first plane and the second plane define a first angle and the second plane and the third plane define a second angle, each of the first angle and the second angle being greater than 180 degrees and smaller than 270 degrees.

11. The fixing device according to claim 10, wherein the fixing rotator includes a fixing belt including a base layer made of resin.

12. The fixing device according to claim 11, wherein the base layer of the fixing belt is made of polyimide.

13. The fixing device according to claim 1, further comprising a movable light shield interposed between the one or more heaters and the fixing rotator to shield the fixing rotator from the one or more heaters, the light shield to move to a plurality of shield positions according to a size of the recording medium.

14. The fixing device according to claim 1, wherein the reflector includes a curve surrounding the one or more heaters.

15. The fixing device according to claim 1, wherein the first minimized interval is 2.5 mm and the second minimized interval is 4 mm.

16. The fixing device according to claim 1, wherein the fixing rotator includes a fixing belt.

17. The fixing device according to claim 16, wherein the fixing belt includes a base layer made of metal.

18. The fixing device according to claim 17, wherein the base layer of the fixing belt is made of nickel.

19. The fixing device according to claim 17, wherein the base layer of the fixing belt is made of SUS stainless steel.

20. The fixing device according to claim 1, wherein the pressure rotator includes a pressure roller.

21. The fixing device according to claim 1, wherein the one or more heaters includes a halogen heater.

22. The fixing device according to claim 21, wherein the fixing rotator includes a fixing belt including a base layer made of resin.

23. The fixing device according to claim 22, wherein the base layer of the fixing belt is made of polyimide.

24. The fixing device according to claim 1, wherein the first minimized interval is a closest distance between an outermost surface of the one or more heaters and an inner circumferential surface of the fixing rotator, and the second minimized interval is a closest distance between the outermost surface of the one or more heaters and a surface of the reflector.

25. The fixing device according to claim 1, wherein the first minimized interval is a closest distance between an outermost surface of the one or more heaters and an inner circumferential surface of the fixing rotator, and the second minimized interval is a closest distance between the outermost surface of the one or more heaters and a surface of the reflector.

26. The fixing device according to claim 1, further comprising:

a nip formation pad to press against the pressure rotator via the fixing rotator to form the fixing nip; and a support being disposed between the nip formation pad and the one or more heaters and supporting the reflector, the support including:

a base portion; and two arms extending away from the base portion.

27. The fixing device according to claim 1, wherein two heaters are tilted relative to a recording medium conveyance direction, and wherein the two heaters are disposed in an upstream compartment inside the fixing rotator that is upstream from the fixing nip in the given direction of rotation of the fixing rotator and the two heaters define a line being oblique in cross-section to the recording medium conveyance direction.

28. The fixing device according to claim 1, further comprising a movable light shield interposed between the one or more heaters and the fixing rotator to shield the fixing rotator from the one or more heaters.

29. The fixing device according to claim 1, further comprising a support supporting the reflector and including:

a base portion; and two arms extending away from the base portion, wherein the reflector includes a concave portion, and wherein the heater includes:

a first portion positioned between the two arms of the support and within the concave portion of the reflector; and a second portion positioned outside of the two arms of the support and the reflector.

30. The fixing device according to claim 1, wherein the one or more heaters include:

an upstream heater, in the given direction of rotation of the fixing rotator, angled relative to a recording medium conveyance direction with a first angle; and a downstream heater disposed downstream from the upstream heater in the given direction of rotation of the fixing rotator and angled relative to the recording medium conveyance direction with a second angle not greater than the first angle.

31. The fixing device according to claim 1, wherein the one or more heaters are disposed upstream from the fixing nip in the given direction of rotation of the fixing rotator.

32. A fixing device comprising:

a fixing rotator rotatable in a given direction of rotation;

a pressure rotator pressed against the fixing rotator to form a fixing nip therebetween, through which a recording medium is conveyed;

one or more heaters disposed opposite the fixing rotator with a first minimized interval between each of the one or more heaters and the fixing rotator to heat the fixing rotator; and a reflector to reflect light emitted by the one or more heaters to the fixing rotator, the reflector disposed opposite the one or more heaters with a second minimized interval between each of the one or more heaters and the reflector that is greater than the first minimized interval wherein a second heater is disposed opposite the fixing rotator with the first minimized interval therebetween to heat the fixing rotator, the second heater disposed opposite the reflector with the second minimized interval therebetween that is greater than the first minimized interval.

33. The fixing device according to claim 32, further comprising:

a nip formation pad to press against the pressure rotator via the fixing rotator to form the fixing nip; and a support being disposed between the nip formation pad and the one or more heaters and supporting the reflector, the support including:

a base portion; and two arms extending away from the base portion.

34. The fixing device according to claim 32, wherein two heaters are tilted relative to a recording medium conveyance direction, and wherein the two heaters are disposed in an upstream compartment inside the fixing rotator that is upstream from the fixing nip in the given direction of rotation of the fixing rotator and the two heaters define a line being oblique in cross-section to the recording medium conveyance direction.

35. The fixing device according to claim 32, further comprising a movable light shield interposed between the one or more heaters and the fixing rotator to shield the fixing rotator from the one or more heaters.

36. The fixing device according to claim 32, further comprising a support supporting the reflector and including:

a base portion; and two arms extending away from the base portion, wherein the reflector includes a concave portion, and wherein the heater includes:

a first portion positioned between the two arms of the support and within the concave portion of the reflector; and a second portion positioned outside of the two arms of the support and the reflector.

37. The fixing device according to claim 32, wherein the one or more heaters include:

an upstream heater, in the given direction of rotation of the fixing rotator, angled relative to a recording medium conveyance direction with a first angle; and a downstream heater disposed downstream from the upstream heater in the given direction of rotation of the fixing rotator and angled relative to the recording medium conveyance direction with a second angle not greater than the first angle.

38. The fixing device according to claim 32, wherein the one or more heaters are disposed upstream from the fixing nip in the given direction of rotation of the fixing rotator.

39. An image forming apparatus comprising:

an image bearer to bear a toner image; and a fixing device, disposed downstream from the image bearer in a recording medium conveyance direction, to fix the toner image transferred from the image bearer onto a recording medium thereon, the fixing device including:

a fixing rotator rotatable in a given direction of rotation;

a pressure rotator pressed against the fixing rotator to form a fixing nip therebetween, through which the recording medium is conveyed;

one or more heaters disposed opposite the fixing rotator, with a first minimized interval between each and every heaters to heat the fixing rotator; and a reflector to reflect light emitted by the one or more heaters to the fixing rotator, the reflector disposed opposite the one or more heaters with a second minimized interval therebetween that is greater than the first minimized interval.

* * * * *